United States Patent [19]

Bergvall

[11] 4,422,394

[45] Dec. 27, 1983

[54] SEWING GUIDE OF A SEAM PATTERN SEWING MACHINE

[75] Inventor: Bengt A. Bergvall, Huskvarna, Sweden

[73] Assignee: Husqvarna Aktiebolag, Huskvarna, Sweden

[21] Appl. No.: 325,429

[22] PCT Filed: Mar. 19, 1981

[86] PCT No.: PCT/SE81/00090

§ 371 Date: Nov. 19, 1981

§ 102(e) Date: Nov. 19, 1981

[87] PCT Pub. No.: WO81/02751

PCT Pub. Date: Oct. 1, 1981

[30] Foreign Application Priority Data

Mar. 19, 1980 [SE] Sweden ..... 8021397

[51] Int. Cl.[3] ..... D05B 3/02

[52] U.S. Cl. ..... 112/158 F; 112/158 E

[58] Field of Search ..... 112/158 F, 158 E, 121.11, 112/121.12, 314, 315, 272

[56] References Cited

U.S. PATENT DOCUMENTS

| | | | |
|---|---|---|---|
| 4,166,423 | 9/1979 | Brienza et al. | 112/158 E X |
| 4,236,467 | 12/1980 | Tanaka et al. | 112/158 F X |
| 4,270,472 | 6/1981 | Suzuki et al. | 112/158 F X |
| 4,292,905 | 10/1981 | Widmer | 112/121.11 |
| 4,370,938 | 2/1983 | Bergvall | 112/158 E |

*Primary Examiner*—Peter P. Nerbun

*Attorney, Agent, or Firm*—Alfred E. Miller

[57] ABSTRACT

A seam pattern sewing machine has a plurality of seam pattern selecting switches, and a separate indicator associated with each of the switches. Operation of the switches causes the generation of a seam selection code or start address code, in accordance with the selected switch, for application to a selection address memory. A second selector has a plurality of positions corresponding to characteristics of the material to be sewn. An encoding device is coupled to the second selector for energizing the indicators associated with those seam pattern selector switches corresponding to seams that may be sewn on the selected material.

8 Claims, 4 Drawing Figures

Figure 1:
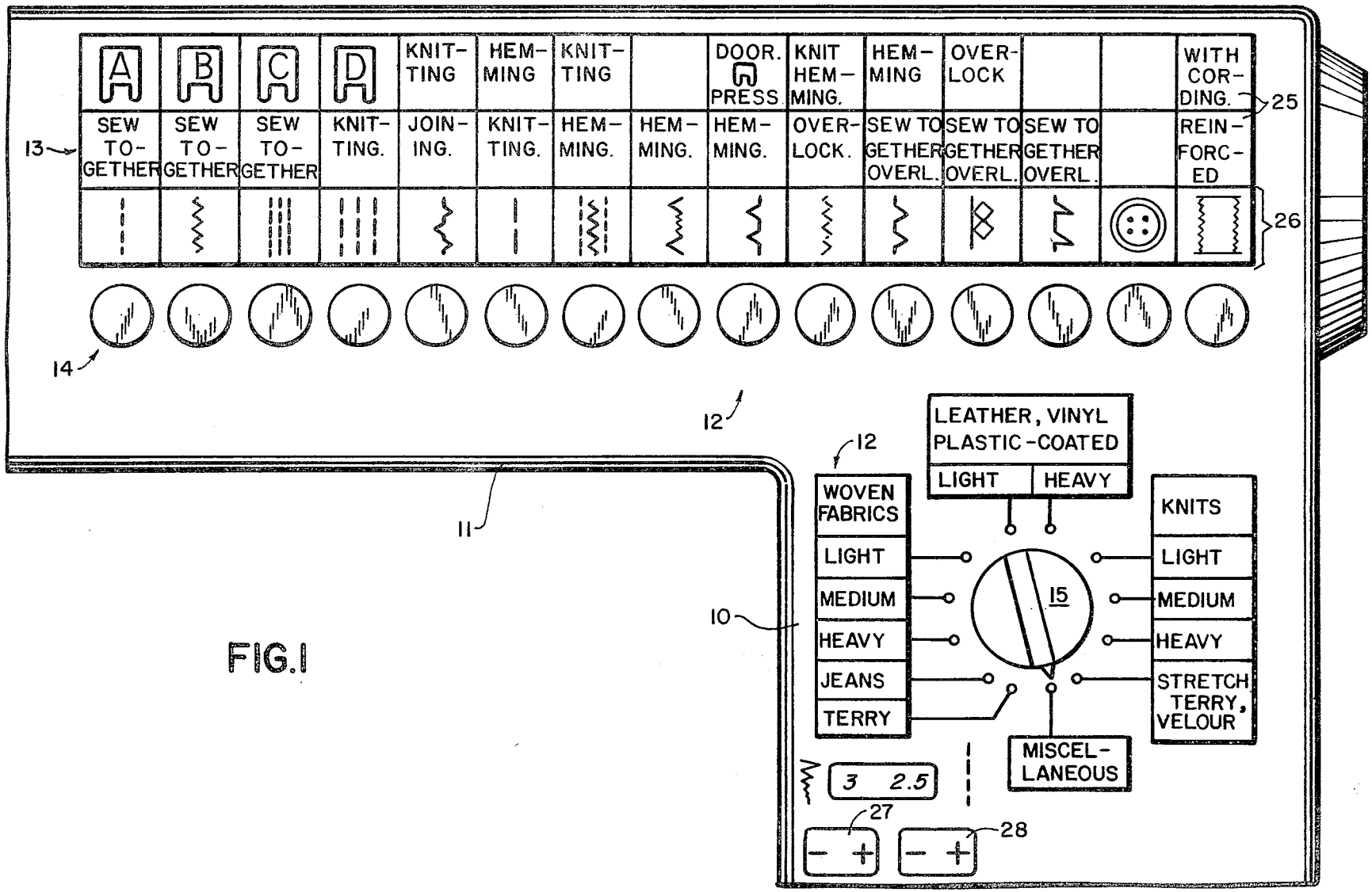

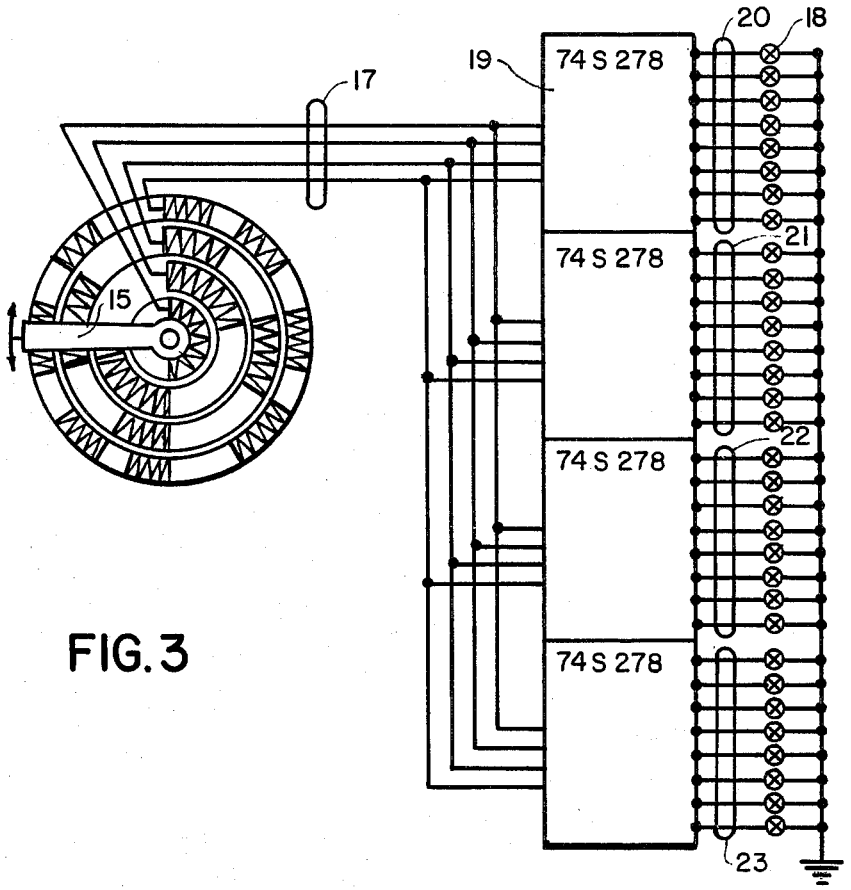
FIG. 3
FIG. 4
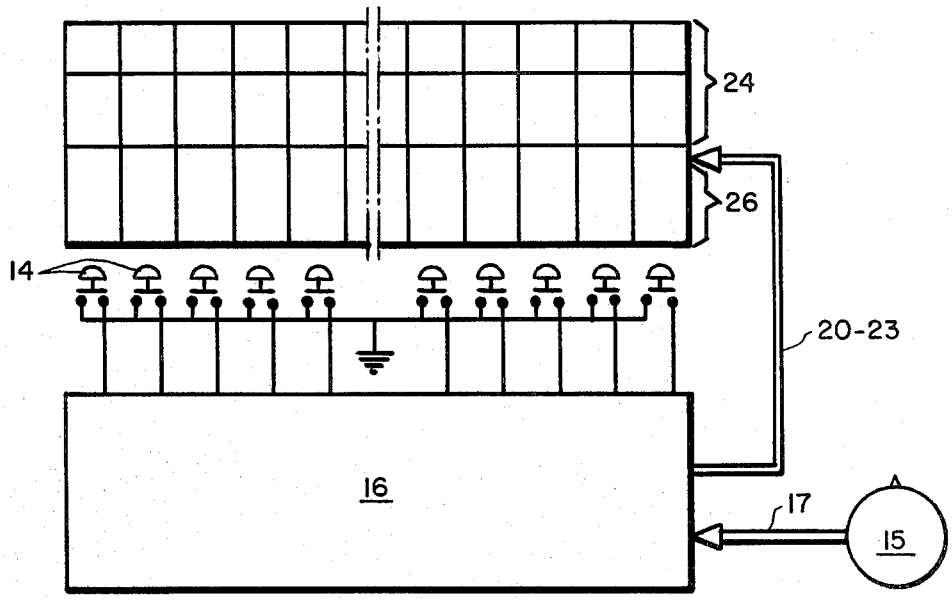

SEWING GUIDE OF A SEAM PATTERN SEWING MACHINE

The present invention relates to an arrangement for making a seam choice, and is especially relates to a built-in sewing guide in an electronic sewing machine with an electronic seam memory for the supply of stitch data to the needle positioning and cloth feeding mechanisms.

Electronic fancy seam data systems for sewing machines have, in general, among other things, an input selector, e.g. a set of push button switches with a row of symbols showing the seam the machine will sew, when a push button referred to a certain symbol is actuated. The choise of one of the several symbols and eventually other controls must, however, be made by the operator. This can be difficult with regard to the selection of cloth quality and the appropriateness of the several seams. Most sewing machines have a manual which provides advice on the adjustment of the machine. If it provides an extensive programme of fancy seams, such a manual will be large and inconvenient and confuse the one who operates the several controls. The prior art therefore presented arrangements in fancy seam data systems having an input selector with a so called cloth control as an essential feature, since the several textures or qualities of sewing stuff demand quite different adjustments on the machine, even if one and the same function of the performed seam exists. Stich codes for every seam are stored in the electronic start memory. A address word from the input selector adjusts e.g. a counter to the first stitch code of the selected seam. Adjustments on another texture or another function provide an address word representing such other adjustments which release codes for another seam, etc. The address counter releases the code words of the subsequent stitches one by one from the memory in a known manner when the fancy seam is sewn.

However, the art here referred to permits a plurality of different seam patterns for one and the same function (or operation). Modern sewing machines have, for instance for the operation "Sew together", at least three different seams i.e. straight seam, zigzag seam and reinforced straight seam. The plurality of alternative seams for every operation could make the sewing complicated, if there were no effective instruction accessible at or on the machine. The present invention is related to a system for making the information on the several alternatives for every operation accessible, that is introduced and stored in the memory of the machine. The seams which are less suitable in a certain combination of texture and operation are not shown on this information. Switch means are provided at the symbols for the shown suitable seams for selection of these seams. When such a seam is selected, the input selector supplies a start address to the counter, and feeding of ideal data for the cloth and operation in question is effected from the stitch memory. The advantage of such a system residing in the fact that the operator directly after the adjustment of the cloth control obtains information for the next adjustment referred to the operation.

Figure 2:
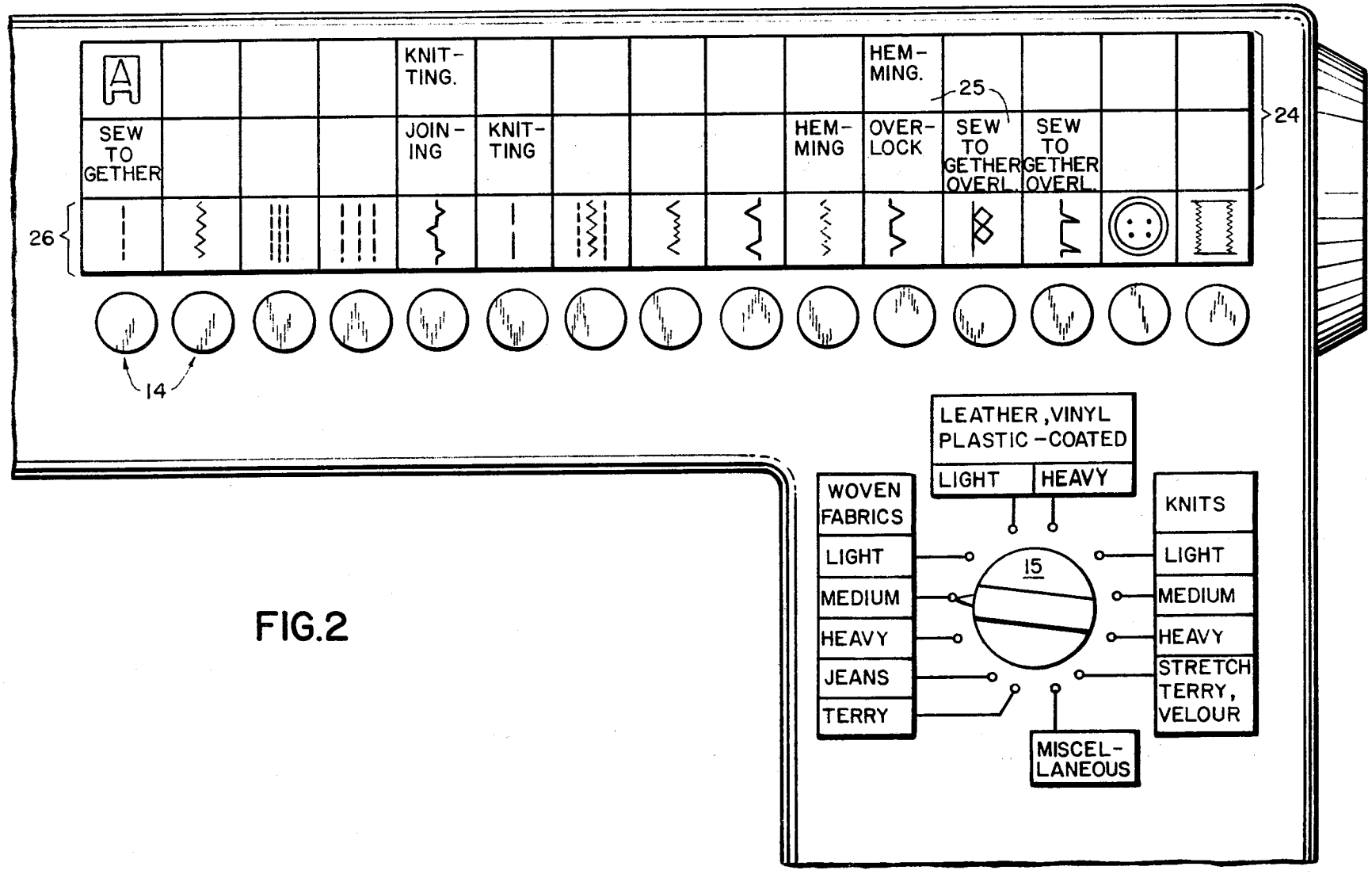

An embodiment of a sewing guide according to the invention is described in the following disclosure with reference to the attached drawings wherein FIG. 1 shows a control panel on the front surface of a sewing machine, FIG. 2 shows the same panel but a certain adjustment of a rotary control thereon, FIG. 3 is a wiring diagramme of the indicating means in the panel, FIG. 4 is a wiring diagramme of the input selector in the panel.

On a sewing machine provided with a post 10 and an over-arm 11 there is mounted a control panel 12 with indicating means 13, buttons 14 and a rotary control 15, which are used for informing the electronic system 16 of the machine of a certain seam selection. The rotary control is used for making a preadjustment on a series of seam patterns, e.g. utility seams, of which at least one can be selected on the buttons 14. Such a rotary control is suitably constituted of a binary converter with for instance four output lines 17 on which an output four bit code represents a certain adjustment on the rotary control. The several positions are marked by text on the panel stating, in the shown embodiment, the texture of the material to be sewn. The rotary control can, for instance, be designed as shown in FIG. 3 which also shows the connection of a number of lamps 18 (light emitting diodes) to a memory unit 19 constituted of four partial memories which are 74S 278 TTL devices. The wires 17 are branched to every one of the partial memories which have 8 outputs 20–23 each. The memory unit is programmed for supplying current on a special combination of wires in the groups 20–23 corresponding to the input code on the wires 17. First said wires supply current to light the corresponding lamps, and these lights thereby inform the operator about the seam patterns which can be selected for the earlier made preadjustment of the rotary control can be selected. In FIG. 2 an example of a preadjustment of the control 15 and a couple of rows of illuminated text 24 are shown indicating the several operations that may be effected on the material pointed out by the control 15. The text in every square 25 made of transparent material, is illuminated from behind by the corresponding lamp. When light is out the text is not visible. Below the text squares another row of squares 26 is positioned showing a symbol of the seam described by the text in the square above. Besides a description of the operation the text may include practical hints on extra measures for the accomplishment of the seam, for instance, changing the presser foot and the like. After any adjustment of the buttons 14 the zigzag width and the stitch length can be adjusted individually on a couple of controls 27,28.

The information on the illuminated text squares is used for the completion of a seam selection, which is made so that the operator pushes a button 14, whereby a so called seam selection code (or start address) is created and applied to a start address memory in the electronic unit. This unit is composed of many parts in the form of circuit cards and components, which are not here separately stated or described, as a plurality of embodiments are known and the invention does not refer to a special embodiment of the electronic unit for controlling the needle and feeder. However, an example of such a unit is described in the Swedish patent specification No. 7910201-8, which may be referred to for the sake of completeness.

The embodiment now described is an example how to realize the invention. As a variation of the "cloth control" it may be mentioned that the handle 15 may be replaced by buttons or a slide control. Even though the application of the invention in an electronic sewing machine is described in the foregoing, the invention is not restricted to such application but can advantageously also be applied to sewing machines with mechanical zigzag stitch control, such as cam discs.

I claim:

1. In a seam pattern sewing machine having a seam pattern selector including a plurality of switch means and means responsive to the operation of the switch means for selectively creating seam selection codes, and separate indicator means associated with each of said switch means; the improvement comprising a second selector having positions corresponding to characteristics of a material to be sewn, and encoding means coupled to said second selector for energizing selected ones of said indicators at each position of said second selector, for indicating the seams that may be sewn on the chosen material.

2. The seam pattern sewing machine of claim 1 wherein at least some positions of said second selector correspond to the texture of the material to be sewn.

3. The seam pattern sewing machine of claim 1 wherein at least some of said positions correspond to the thickness of the material to be sewn.

4. The seam pattern sewing machine of claim 1 further comprising a schedule associated with each of said indicators and related to the respective seam operation.

5. The seam pattern sewing machine of claim 4 wherein the schedule provides information for the selection of a presser foot.

6. The seam pattern sewing machine of claim 4 wherein the schedule includes text or symbols related to the respective seam pattern, and said indicators comprise lamps for illuminating said text or symbols.

7. The sewing machine of claim 1 wherein said encoding means comprises a memory, said second selector being connected to provide address signals for said memory, said indicators comprising lamps selectively coupled to the output of said memory, whereby determined ones of said lamps are energized at each respective position of said second selector.

8. The seam pattern sewing machine of claim 7 wherein said second selector comprises a rotary switch having a plurality of switched conductors coupled to said memory for addressing said memory.

* * * * *

UNITED STATES PATENT OFFICE

CERTIFICATE OF CORRECTION

Patent No. 4,422,394 Dated December 27, 1983

Inventor(s) BENGT ALLAN BERGVALL

It is certified that error appears in the above-identified patent and that said Letters Patent are hereby corrected as shown below:

On title page change March 19, 1980 [SE] Sweden 8021397 to read as follows:

-- [30] Foreign Application Priority Data

March 19, 1980 [SE] Sweden 8002139 --

Signed and Sealed this

Eighth Day of May 1984

[SEAL]

Attest:

GERALD J. MOSSINGHOFF

Attesting Officer

Commissioner of Patents and Trademarks